US008479927B2

(12) United States Patent
Vulpitta

(10) Patent No.: US 8,479,927 B2
(45) Date of Patent: Jul. 9, 2013

(54) GRAVITY FED PEG MERCHANDISING SYSTEM

(75) Inventor: Brian A. Vulpitta, Avon Lake, OH (US)

(73) Assignee: Shurtech Brands, LLC, Avon, OH (US)

( * ) Notice: Subject to any disclaimer, the term of this patent is extended or adjusted under 35 U.S.C. 154(b) by 154 days.

(21) Appl. No.: 13/098,821

(22) Filed: May 2, 2011

(65) Prior Publication Data

US 2011/0266235 A1 Nov. 3, 2011

Related U.S. Application Data

(60) Provisional application No. 61/330,643, filed on May 3, 2010.

(51) Int. Cl.
*A47F 5/08* (2006.01)

(52) U.S. Cl.
USPC ..... 211/59.1; 211/57.1; 211/106

(58) Field of Classification Search
USPC ..... 211/59.1, 57.1, 54.1, 7, 106.01, 106, 211/193, 87.01, 181.1; D6/566; 248/220.31, 248/220.41, 220.42, 220.43, 222.51, 223.41
See application file for complete search history.

(56) References Cited

U.S. PATENT DOCUMENTS

| | | | | | |
|---|---|---|---|---|---|
| 1,033,915 | A | * | 7/1912 | McDonald | 402/68 |
| 2,912,151 | A | * | 11/1959 | Crabs | 294/156 |
| 3,245,547 | A | * | 4/1966 | Felkay | 248/220.41 |
| 3,374,898 | A | * | 3/1968 | Karmin | 248/220.41 |
| 3,481,481 | A | * | 12/1969 | Witek et al. | 211/49.1 |
| 3,501,015 | A | * | 3/1970 | Behles | 211/49.1 |
| 3,524,616 | A | * | 8/1970 | Marschak | 248/188.7 |
| 3,780,873 | A | * | 12/1973 | Silva | 211/59.3 |
| 4,343,405 | A | * | 8/1982 | Virte et al. | 211/88.01 |
| 4,606,466 | A | * | 8/1986 | Fredrickson | 211/59.1 |
| 4,742,923 | A | * | 5/1988 | Calvert | 211/57.1 |
| 4,813,535 | A | * | 3/1989 | Radocha et al. | 206/738 |
| 4,944,390 | A | * | 7/1990 | Baucom et al. | 206/762 |
| 5,009,334 | A | * | 4/1991 | Bodkins | 211/54.1 |
| 5,388,709 | A | * | 2/1995 | Adams | 211/70.6 |
| 5,425,461 | A | * | 6/1995 | Larson | 211/88.01 |
| 5,855,282 | A | * | 1/1999 | Hardy | 211/59.1 |
| 6,173,844 | B1 | | 1/2001 | Avery | |
| 6,561,362 | B1 | * | 5/2003 | Cummins | 211/49.1 |
| 6,575,314 | B2 | * | 6/2003 | Lung et al. | 211/163 |
| 6,783,011 | B2 | * | 8/2004 | Rodrigue | 211/59.1 |
| 6,811,128 | B1 | * | 11/2004 | Wagner et al. | 248/220.31 |
| 6,877,616 | B2 | * | 4/2005 | Plutsky | 211/43 |
| 6,883,671 | B2 | * | 4/2005 | Rushing | 211/88.01 |
| 7,219,806 | B1 | * | 5/2007 | Morrow | 211/59.1 |
| 7,219,808 | B2 | * | 5/2007 | Wright et al. | 211/70.6 |
| D551,007 | S | * | 9/2007 | Trinko | D6/566 |

(Continued)

FOREIGN PATENT DOCUMENTS

FR 2821255 2/2001

*Primary Examiner* — Jennifer E Novosad
(74) *Attorney, Agent, or Firm* — Fay Sharpe LLP

(57) ABSTRACT

A merchandising display using pegs mounted on peg board slopes the pegs downwardly from back to front and has a product retaining bar disposed below the pegs a distance calculated to engage the bottom of products displayed on the pegs. The merchandising display pegs are sloped at an angle calculated to allow gravity to draw products from the back of the peg to the front of the peg as products are removed while the bar engaging the bottom of the products maintains the forward most product at the optimum display angle for purchasers.

17 Claims, 16 Drawing Sheets

U.S. PATENT DOCUMENTS

| | | | | |
|---|---|---|---|---|
| 7,278,617 | B2 * | 10/2007 | Valiulis et al. | 248/220.31 |
| 7,584,930 | B2 * | 9/2009 | Zich | 248/220.31 |
| 7,909,183 | B2 * | 3/2011 | Oh | 211/59.1 |
| D660,066 | S * | 5/2012 | Webb et al. | D6/566 |
| 8,240,486 | B2 * | 8/2012 | Niederhuefner et al. | 211/51 |
| D669,291 | S * | 10/2012 | Johnson et al. | D6/566 |
| 2003/0111433 | A1 * | 6/2003 | Park | 211/59.1 |
| 2006/0091092 | A1 * | 5/2006 | Vosbikian | 211/87.01 |
| 2007/0102377 | A1 * | 5/2007 | Kikuchi et al. | 211/57.1 |
| 2007/0102379 | A1 * | 5/2007 | Strand | 211/59.1 |
| 2007/0251898 | A1 * | 11/2007 | Aarts | 211/57.1 |
| 2008/0149576 | A1 * | 6/2008 | Onachilla et al. | 211/85.5 |
| 2009/0032482 | A1 * | 2/2009 | Battaglia | 211/59.1 |
| 2011/0266235 | A1 * | 11/2011 | Vulpitta | 211/59.1 |

* cited by examiner

GRAVITY FED PEG MERCHANDISING SYSTEM

RELATED APPLICATIONS

This application claims the priority of U.S. Provisional Application Ser. No. 61/330,643, filed on May 3, 2010, which is incorporated herein in its entirety, by reference.

FIELD OF THE DISCLOSURE

The present disclosure relates to merchandising systems as used in stores presenting products to consumers and more particularly to systems presenting products on pegs.

BACKGROUND OF THE DISCLOSURE

Products are presented to consumers in various ways at retail stores. Some products are presented on shelves. Some products are presented on pegs. Some products are presented in other ways.

Many retail stores are organized with parallel shelves or other product supporting structures running a substantial portion of the width or length of the store. Aisles are disposed between the product support structures. Consumers walk along the aisles and select the products they wish to purchase from the product support structures on the two sides of the aisles. Many retailers want to present products to consumers in an orderly, attractive manner. To this end, there is a generally defined product containing volume in which the product support structures are located and in which the products are located. Customer access areas, the aisles, are adjacent these product containing volumes.

It is advantageous to display products in a proper orientation near the front of the product containing volumes where they can be easily seen by the consumer. It is also advantageous to have products easily removed from the product containing volumes by the consumer.

It is also advantageous to contain a large number of products in the product containing volumes whereby adequate variety and stock for the consumer are presented.

SUMMARY OF THE DISCLOSURE

In accordance with the disclosure, a merchandising display is provided for products adapted to be displayed hanging from pegs in a product containing volume having a back and a front. Pegs, or rods, are supported near the back end at the back of a product containing volume and slant downwardly and forwardly to their front ends. The front ends of the pegs are disposed near the front of the product containing volume. Several pegs for similar products may be disposed one next to the other. A product retaining bar extends generally horizontally near the front of the product containing volume below the front of the pegs and adjacent to the front of the pegs. The product retaining bar is spaced below the front of the pegs a distance similar to the height of the products being displayed. The pegs slant downwardly from back to front at an angle sufficient to cause the products mounted on the pegs to move to the front of the pegs by action of gravity when front products are removed. A product becoming the front product on the peg is held in a vertical position at the front of the peg when the product engages the product retaining bar adjacent its bottom.

Further in accordance with the disclosure, the slant angle of the rod or peg is greater than about 10° and preferably about 15°.

Still further in accordance with the disclosure, the slant angle of the peg or rod is selected from the range of 10° to 30° depending upon the weight of the products supported on the peg.

Still further in accordance with the disclosure, the peg or rod does not have a substantially upstanding front end piece holding products on the peg or rod.

Still further in accordance with the disclosure, a product description header is disposed at a slant angle similar to the slant angle of the pegs above the peg slightly rearwardly of the front of the pegs providing product description information to consumers.

It is a principal object of the disclosure to provide a merchandising display system which holds a large number of products for purchase by consumers and which will present the front products of sets of products on pegs to the consumer in an optimal orientation at the front of the pegs regardless of the number of product units on the pegs.

It is another object of the disclosure to provide a merchandising display system which allows products to be easily removed from the display by consumers.

It is still another object of the disclosure to provide a merchandising display system which is easy to stock, neat in appearance, provides for optimal visibility of products offered to consumers, provides for ease of product selection by consumers and is inexpensive to construct and maintain.

In accordance with one aspect, a merchandising display for displaying associated products having a height and a depth adapted to be displayed hanging from pegs comprises a product containing volume having a back and a front, said front being accessible to consumers, a rod having a back end and a front end, said back end supported near said product containing volume back, said rod front end being disposed near said product containing volume front, said rod slanting downwardly from said back end to said front end at a slant angle, and a product retaining bar extending across the product containing volume parallel to and adjacent the front of the product containing volume, the bar being spaced below the front end of the rod less than the associated product height and being positioned in the front to back direction with relation to said rod front end such that the product engages the bar while being supported by the rod, whereby the product is retained on the rod and presented in a generally vertical orientation adjacent the front of the product containing volume regardless of the number of products on the rod.

The slant angle can be between ten and thirty degrees, for example. The display can further comprise a vertically extending support member at the back of said product volume, wherein the back end of the rod is connected to said support member and said rod extends from the support member in a cantilevered manner. The vertically extending support member can include, for example, a peg board. The product retaining bar can be supported on the vertical support and can extend therefrom in a cantilevered manner. The display can further comprise a product support structure including an upper rod segment, a back rod segment, and a lower rod segment, the upper rod segment adapted for retaining a product thereon and the lower rod segment adapted for supporting the product retaining bar. The product support structure can be a unitary piece, and the back rod segment can be secured to the vertically extending support member.

The upper rod segment and lower rod segment can extend in spaced apart relation from the back rod segment, and can be parallel along a major portion of their respective lengths. In another embodiment, the upper rod segment and lower rod segment can extend in spaced apart relation from the back rod segment, with distal ends of the upper and lower rod segments being spaced farther apart than proximal ends of the upper and lower rod segments.

The merchandising display further comprises a plurality of rods, wherein the product retaining bar extends across the front of the product containing volume and is spaced below the front ends of the plurality of rods. At least two of the plurality of rods can have different shapes. A header board can be provided that extends across the product containing volume parallel to and adjacent the front of the product containing volume. The header board can be releasably attached.

Further objects and advantages of the system will occur from the following detailed description of an embodiment thereof and from the accompanying illustrations in which:

DETAILED DESCRIPTION

Figure 1:
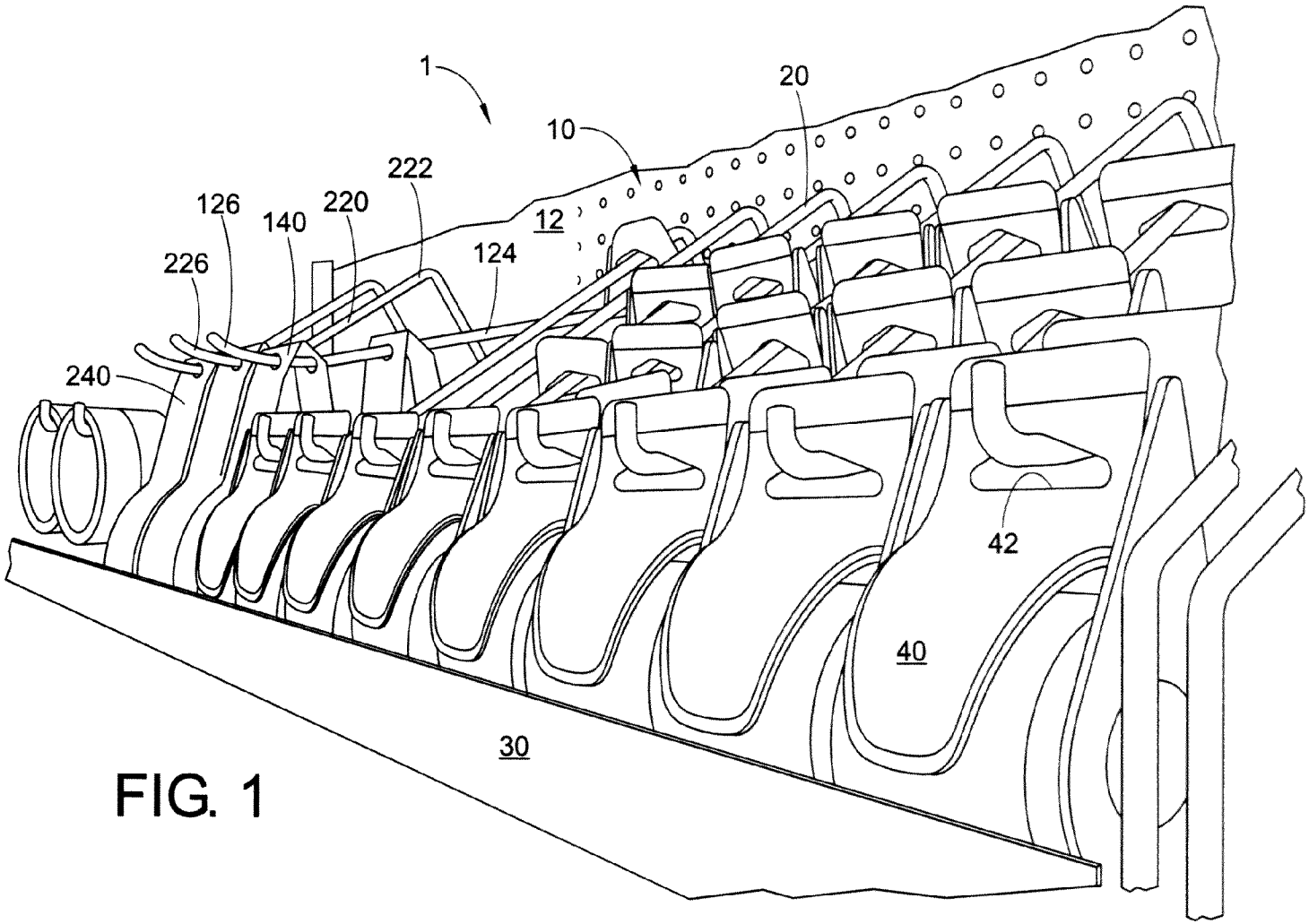
FIG. 1 is a perspective view of a merchandising display system in accordance with the disclosure displaying a variety of tape products.
Figure 2:
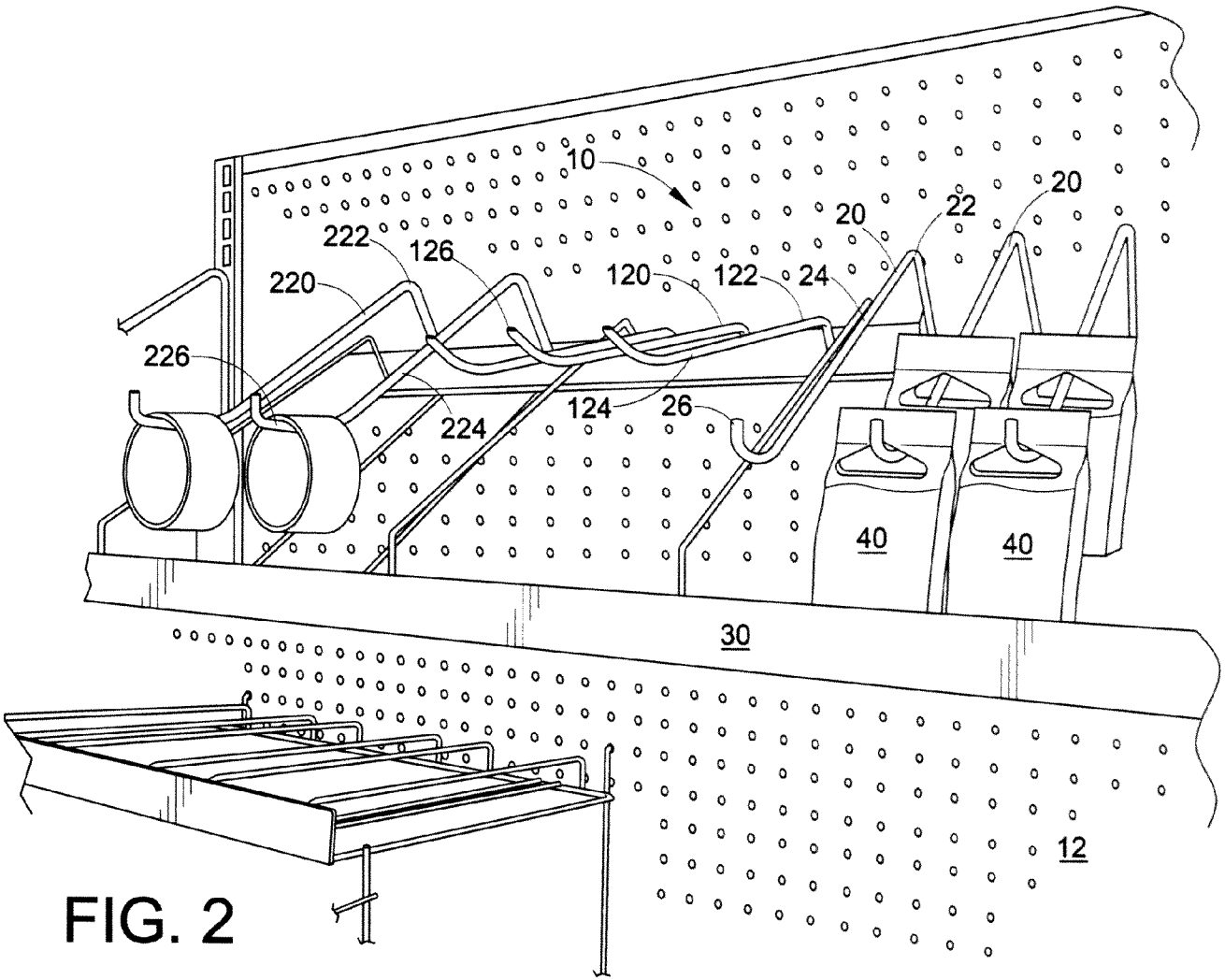
FIG. 2 is a perspective view of a merchandising display system of FIG. 1 with some of the products removed showing the product support structures more clearly.
Figure 3:
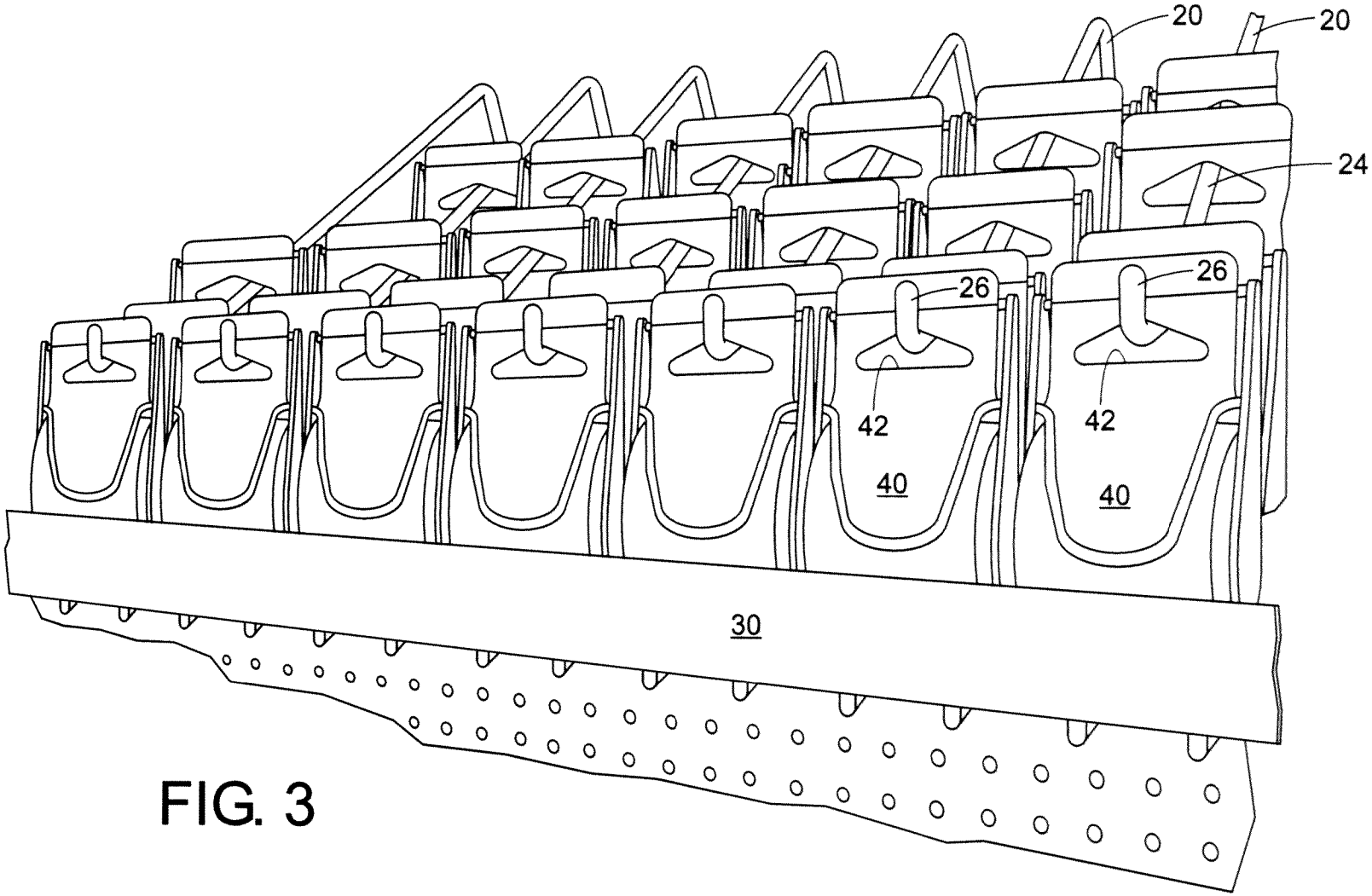
FIG. 3 is another perspective view of the merchandising display system of FIG. 1 showing more of a front view than FIGS. 1 and 2.

Referring now to the drawings and figures wherein the showings are for the purposes of illustrating embodiments of the disclosure and not for the purposes of limiting the same, FIGS. 1, 2 and 3 show a merchandising display system usable for products capable of being displayed on pegs or hooks. This includes a very wide variety of products sold at retail including tape products, small household products, and many other package products in which a hole is provided in the package near the top for mounting on a hook. Some of such products are similar to tape products in that they are on a dispenser having a convenient hole for use with the peg. Others are small loose products in blister packs or mounted on cardboard which can be conveniently pierced for mounting on hooks. Many such products have tops with a shallow depth and a lower portion having greater depth. Thus, the products or the products contained in a package have less depth from front to back at the top than elsewhere in their profile.

Consumer products are often packaged or labeled with a principle display panel. This principle display panel often contains the name of the product, the quantity of the product in the package being sold, a trademark identifying the product and other information of importance to consumers. Principal display panels are often very carefully designed to present this information in a way that is readily understood by the consumer and in a positive way likely to lead to a sale. When products are simply jumbled together on a shelf, the principal display panel is not always presented in its most visible orientation to the consumer. This can make product selection more difficult to the consumer. Moreover, if the principle display panels of several different but related products are not presented properly to the consumer, the consumer may not even be aware that the product he is seeking is available.

As can be seen in FIG. 1, the merchandising display system of the present invention presents products in an orderly way with the principle display panels presented in an optimum orientation.

The merchandising display system 10 is illustrated cooperating with a peg board 12. The various elements of the merchandising display system 10 are mounted on the peg board 12 in a conventional way. Such systems are not always mounted on and cooperate with the peg board. Some retailers use shelving systems in which horizontal slots support pegs or rods rather than peg board. The present system will operate with any of these known equivalent systems in retail.

Many retail stores use shelving systems which have a central vertically extending element with product containing volumes on both sides of this central vertical element. The element can be a substantially vertical wall. These shelving systems extend for a substantial distance and are disposed as several parallel sets with consumer accessible aisles between the shelving units. Product containing volumes are disposed on both sides of the central element. Consumers are presented with products on both sides of the aisles in these product containing volumes. The product containing volumes are often comprised of shelves, one on top of the other, displaying products on these shelves. These product containing volumes are sometimes arrays of pegs displaying products spaced vertically and horizontally. Retail stores often have both shelves and peg areas depending upon the products being offered. It will be appreciated that an orderly presentation makes most efficient use of the space presented to the consumer to make a sale. Thus, if one wishes to present a number of different products which are related but address somewhat different needs or come in different sizes, it is desirable to present these products in an orderly manner with the information differentiating the products one from the other orientated to be easily read by the consumer. Moreover, it is desirable for the leading unit of a multiple unit display to be close to the consumer at the front of the product containing volume.

On ordinary horizontal shelves, this can be done manually by stock people moving items to the front as the first items are purchased. In some stores, this is done automatically with spring loaded display shelves.

In the present embodiment, products are disposed on pegs or rods 20. Products such as a roll of tape on a dispenser 40 with a hole 42 through the dispenser top are threaded onto the pegs 20. Multiple units 40 of a roll of tape are threaded on to each individual rod 20. The rod 20 has a back end 22 which is fixed in place on or near the peg board 12 at the back of the product display volume. The rod or peg 20 has an intermediate sloped portion 24 and a front end 26. The sloped portion 24 slopes downwardly to the front with the front end 26 being adjacent the front boundary of the product display volume.

The front boundary of the product display volume is not a well defined plane or line. Rather, it is an ill-defined boundary between products being displayed for sale and the area reserved for consumers walking between the displayed products.

With reference to FIG. 2, two identical pegs 20 are seen in the right hand portion of the illustration. One peg 20 has a number of tape on tape dispenser products arrayed on the hook 20 while the hook 20 immediately to its left is empty. Looking at the empty peg 20, one sees that the peg intermediate portion 24 is generally straight and sloped downwardly at angle of about 25° with respect to the horizontal from back to front. At the front end 26 of the peg, the peg is curved into a short horizontal portion and then a short vertical upstanding portion at the very end of the peg. Looking at the populated peg immediately to the right, one sees that this structure will support several rolls of tape. Moreover, it is seen that these pegs are spaced horizontally, one from the other, a width sufficient to support rolls of tape immediately adjacent one another. This makes maximum usage of the display facing provided in the product display volume.

A product retaining bar 30 is provided below the front ends 26 of the pegs 20. The product retaining bar 20 is spaced below the front ends 26 of the pegs 20 a distance somewhat less than the distance between the hole 42 in the product 40 and the bottom of the product. The product retaining bar 30 is generally parallel to the plain of the peg board 12 and spaced from the peg board a distance to cooperate with the spacing of the front end 26 of the peg 20. The distance from the peg board 12 to the product retaining bar 30 is selected to engage the product 40 at its bottom when the product 40 is held at the front end 26 of the peg 20. If not for the product retaining bar 30, the product 40 might fall off the end of the peg or might be pushed by product behind it into a position other than vertical. If the bottom of the product 40 is pushed upwardly by the products behind it, its principal display panel becomes difficult to read and it may be missed by the consumer and thus not purchased.

Referring to FIG. 1, a second peg configuration 120 is disclosed to the left of the set of first pegs 20. Three of the second pegs 120 are illustrated in both FIG. 1 and FIG. 2. The pegs 120 in FIG. 2 are empty while the pegs 120 in FIG. 1 are populated with tape on dispenser products. The peg 120 has a back end 122 and an intermediate sloped portion 124 and a front end 126. The back end 122 is fixed in place adjacent the peg board 12. The intermediate portion 124 slopes downwardly to the front. The front end portion 126 is gently curved to an upwardly sloping end piece. This peg or rod 120 does not have the upstanding vertical portion seen with respect to the first peg or rod 120. It is not necessary in the display system of the present disclosure. Referring again to FIG. 1, one sees that the product 140 displayed on the peg 120 is taller than the product 40 displayed on the peg 20. Moreover, the product 140 is heavier. The product 140 is a 55 yard roll of tape which is significantly heavier than the 12 or 22 yard rolls of tape displayed on the pegs 20. Applicant has found that the slope or slant angle of the intermediate sloped portions 124, 24, needed to cause tape products to slide to the front of the pegs differs depending, in part, on the weight of the product being supported. For a light roll of tape on a dispenser, an increased angle of slope of the intermediate portion such as 25° is necessary so that tape dispensers on the back of the peg will slide to the front when a consumer takes the leading tape dispenser off the peg. With a heavier tape product 140, a lesser angle such as 12° or 15° is all that is necessary to assure that the rearward units will slide forward when the forward unit on the peg is removed. Thus, the peg 120 has an intermediate slope portion which slopes downwardly to the front at an angle of 15° or even 10° with respect to the horizontal rather than the 25° seen with respect to the peg 20.

The pegs 120 have rearward ends 122 which are disposed at a lower height than the rearward ends 22 of the pegs 20. Moreover, the front end 126 of the peg 120 is somewhat higher when compared to the forward end 26 of the peg 20. This positions the bottom of the taller product 140 appropriately with the product retaining bar 30 so that this product is also maintained with the primary display panel at an optimum display angle for the consumer. This also allows the maximum number of units to be loaded in the product containing volume allocated to the product by the retailer.

Referring again to FIG. 1, a third set of hooks 220 with products 240 on the pegs are seen to the left of the second set 120, 140. The pegs 220 are shown stocked with product in FIG. 1 and shown empty of product in FIG. 2. Referring to FIG. 2, one can see that the peg 220 resembles the pegs 120 and 20 in that it consists of a back end 222, an intermediate slope portion 224 and a front end 226. The product being displayed on the peg 220 is different in that it is a roll of tape on a dispenser displayed with the hook through the core of the roll of tape rather than through an aperture in the dispenser perpendicular to the axis of the core of the roll of tape. The product is turned 90° with respect to the products 40, 140. This results in the surface riding upon the peg 220 being significantly longer than the surface riding upon the pegs in the other products. Thus, the frictional engagement between the product and the peg is different. This may call for a different angle of slope in the intermediate slope portion 124 for this product. However, the operation of the product and the peg and the product retaining bar 30 is the same. Thus, the front most product 240 is supported by the front end 226 of the peg 220. The bottom of the product 240 engages against the product stop bar 30 holding the product in a vertical position with the principle display panel (in this case paper covering one of the circular sides of the roll of tape) orientated properly for easy reading by the consumer. As can be seen in FIG. 2, the front end 226 is provided with horizontal segment to support the roll of tape in this forward presentation station. While the front end 226 is also provided with a vertically upstanding end, this vertically upstanding end is not necessary as the product stop bar will retain the product on the peg 220 without the vertically extending end. Large vertically extending ends are disadvantageous in the present system in that the pegs without vertically extending front ends ease the process of purchase. Consumers find it easier to remove a product from a peg without a large vertically extending front end. The product is easier to purchase.

FIG. 3 is an enlarged illustration of a portion of the display system seen in FIGS. 1 and 2. FIG. 3 shows that multiple products can be densely packed one beside the other with the principle displays easily readable and easily comparable by the consumer. Moreover, the principle display panels of the leading element on each peg, that is the forward element, is presented at the front of the product containing volume where it is most easily seen by the consumer. FIG. 3 also illustrates that the merchandising display system 10 allows for extremely dense packing on the pegs with multiple units contained one behind the other in contact. Even with a full peg, the forward unit is presented in the optimal orientation, not pushed up out of optimum by the units behind it.

Figure 4:
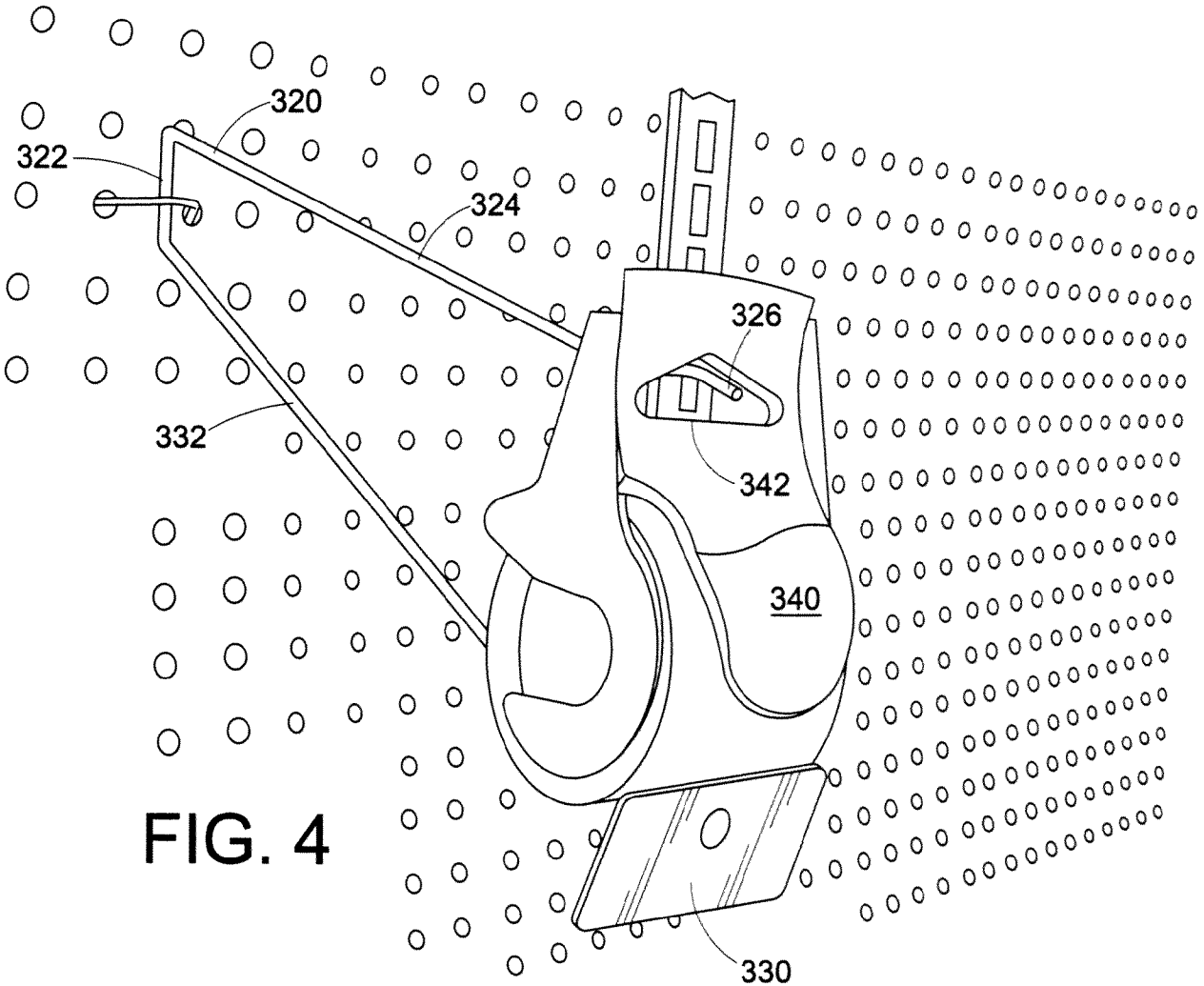
FIG. 4 is a perspective view of an alternate embodiment of the disclosure.

FIG. 4 illustrates an alternate embodiment in which a single peg 320 is part of a unitary structure with an abbreviated product retaining bar 330 supported by a product retaining bar rail 332. The peg 320 has a peg back end 322, a peg intermediate sloped portion 324 and a peg front end 326 in a manner similar to the other pegs thus far described. The peg front end 326 is generally horizontal. The peg intermediate sloped portion 324 slopes downwardly from the back end 322 to the front end 326. The peg back end 322 also has a downwardly extending portion which connects to the product retaining bar support rail 332. The product retaining bar support rail 332 is advantageously parallel to the peg 320 rather than as shown. The product support rail 332 slopes downwardly to a front end which supports the product retaining bar 330 at a distance below the peg front end 326 selected to engage the bottom of the most forward product 340 on the peg 320. As illustrated, this embodiment supports only a limited number of products. However, by moving the rear end of the product retaining bar support rail 332 downwardly so that the product retaining bar support rail 332 is parallel to the peg 320, an increased number of products 340 can be supported on the peg 320 and the product containing volume surrounding the peg used to full advantage. The advantage of the embodiment seen in FIG. 4 (as modified with a parallel retaining bar support rail) is that it allows a retailer to mount any number of individual merchandising display system elements in accordance with the present disclosure on a peg board to take advantage of existing merchandising space. The structures can be sized, that is the spacing across the back and the spacing between the peg 320 and the support rail 330 selected to display various size products and the structures can be engaged on a peg board to maximize use of the available volume.

A header (not shown) may be disposed over the pegs 20, 120, 220 and 320. The header can be 6 to 10 inches in height, and as wide as the display itself. The forward edge of the header is disposed somewhat rearwardly of the front ends 26 of the hooks thereby allowing easy access to product. The header covers the top portion of products behind the most forward product and provides a significant area for marketing communications to the consumer. The header does not interfere with maximum utilization of the product containing volume.

Figure 5:
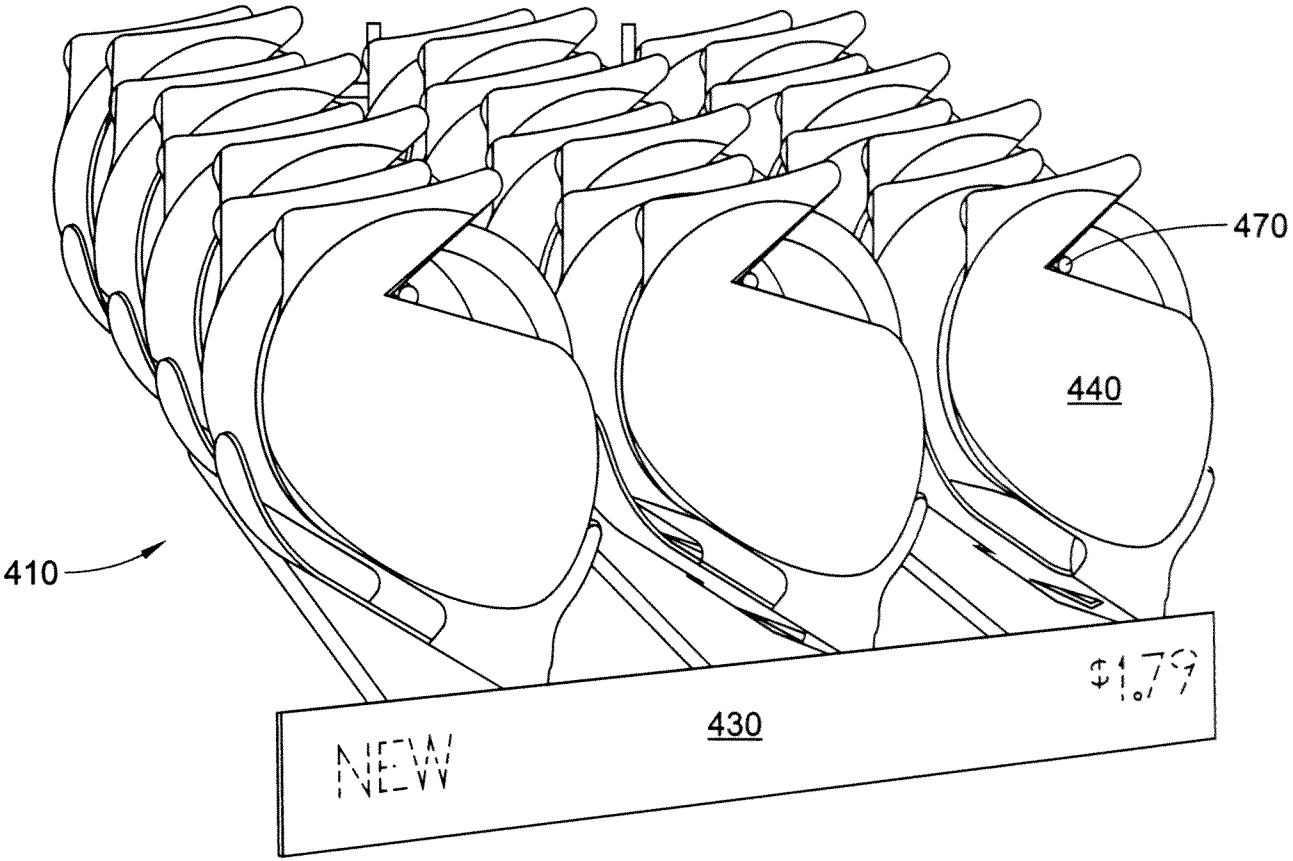
FIG. 5 is a perspective view of another exemplary embodiment similar to that seen in the left hand portion of FIG. 1 loaded with tape on dispensers.
Figure 7:
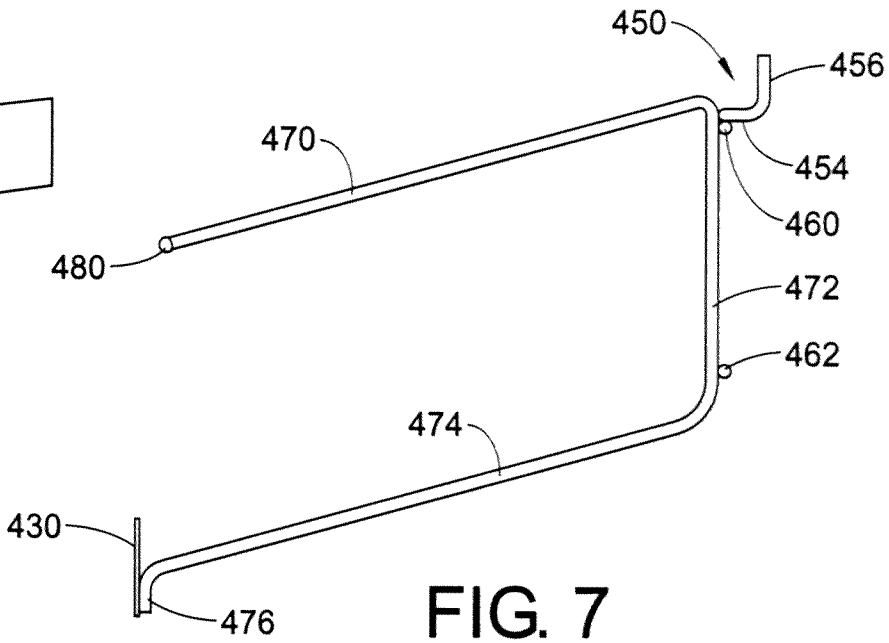
FIG. 7 is a side view of the embodiment of FIG. 6.
Figure 6:
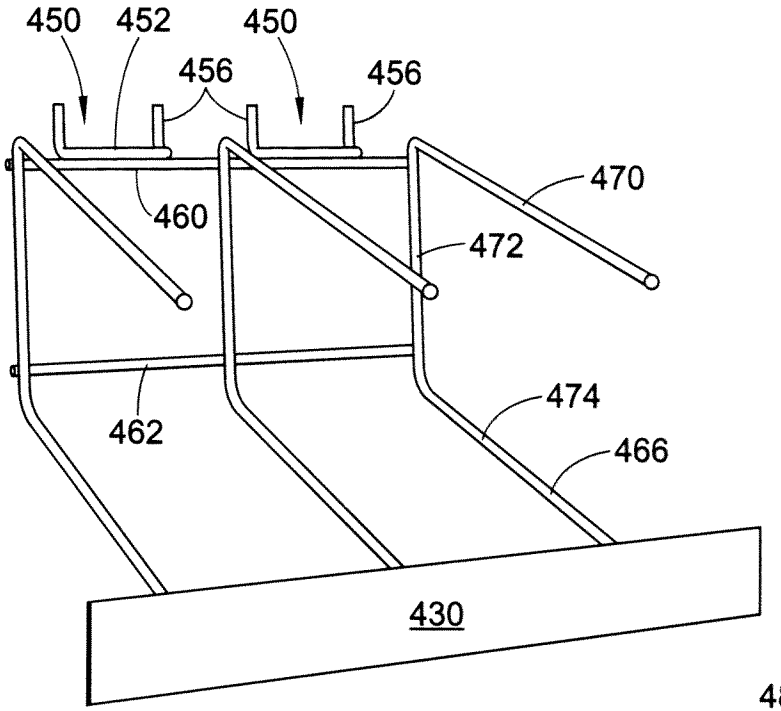
FIG. 6 is a perspective view of the embodiment of FIG. 5 without products loaded.

Turning to FIGS. 5-7, a merchandising display system 410 similar to the embodiments of FIGS. 1-4 is illustrated. In FIG. 5, a plurality of products 440 are supported on respective mounting structures. FIGS. 6 and 7 show the same merchandising display system 410 seen in FIG. 5, without the products 410 loaded thereon.

In the embodiment of FIGS. 5-7, two identical mounting structures 450 are formed from rods of uniform diameter. The mounting structures each comprise a horizontal transverse segment 452 with rearwardly extending segments 454 at each end of the horizontal transverse segment. The rearwardly extending segments are perpendicular to the horizontal transverse segments. Upwardly extending segments 456 extend upwardly from the rear ends of the rearwardly extending segments 454. The horizontal transverse segment 452 has a length selected to position the rearwardly extending segments 454 and the upwardly extending segments 456 spaced to engage holes on conventional peg board. The mounting structures 450 are conventional and are seen in other structures used with peg board.

An upper back support rod 460 is welded to or otherwise fixed to the two horizontal transverse segments 452 of the mounting structures 450. A lower back support rod 462 is parallel to the upper back support rod and spaced below it. Several, in this embodiment three, identical rod or wire structures 466 are welded to the upper and lower back support rods 460, 462. The rod or wire structure 466 comprise an upper rod segment 470, a back rod segment 472, and a lower rod segment 474.

Referring now to FIG. 7, the upper rod segment 470 is straight and slopes downwardly from the back (near the mounting structure 450) to the front at an angle of approximately 12°. The back rod segment is vertical and is fixed to the upper back support rod 460 and lower back support rod 462 by welding or the like. The lower rod segment 474 is parallel to the upper rod segment 470 over the entire length of the upper rod segment 470 and is provided with a downwardly extending end portion 476 at its front end. A product retaining bar 430 is fixed across the front lower portion of the merchandising display system 410 by welding or the like to the front end portions 476 of the lower rod segments 474. As can be seen most clearly in FIG. 7, the upper rod segment 470 is straight over its entire length and has no upstanding portion at its front end. Rather, a small ball 480 or hemisphere or other dressing is selected to provide a smooth non-snagging end on the upper rod segment 470.

As can be seen in FIG. 5, product 440 is supported on the upper rod segments 470 with the lower end of the products engaged against the product retaining bar 430. Products 440 are thereby kept from sliding off the ends of the upper rod segments 470. However, the products 440 are easily taken off the ends of the upper rod segments 470. There is no upstanding end portion making removal difficult. The product retaining bar also presents merchandising display space for information such as pricing or the fact that a product is new directly adjacent the forward most presented product itself.

It can be seen that the upper rod segment 470 acts in a manner very similarly to the operation of the peg or rod 20 seen in previous embodiments. In the embodiment of FIGS. 5-7, a unitary structure sized for a particular product which is easily mounted on the peg board or other display back plane at a retailer is provided. This provides significant flexability in planning of the retail store product containing volume. It should be remembered that the mounting structures 450 can easily be changed to other mounting structures which will engage other retail store shelving back planes.

Figure 8:
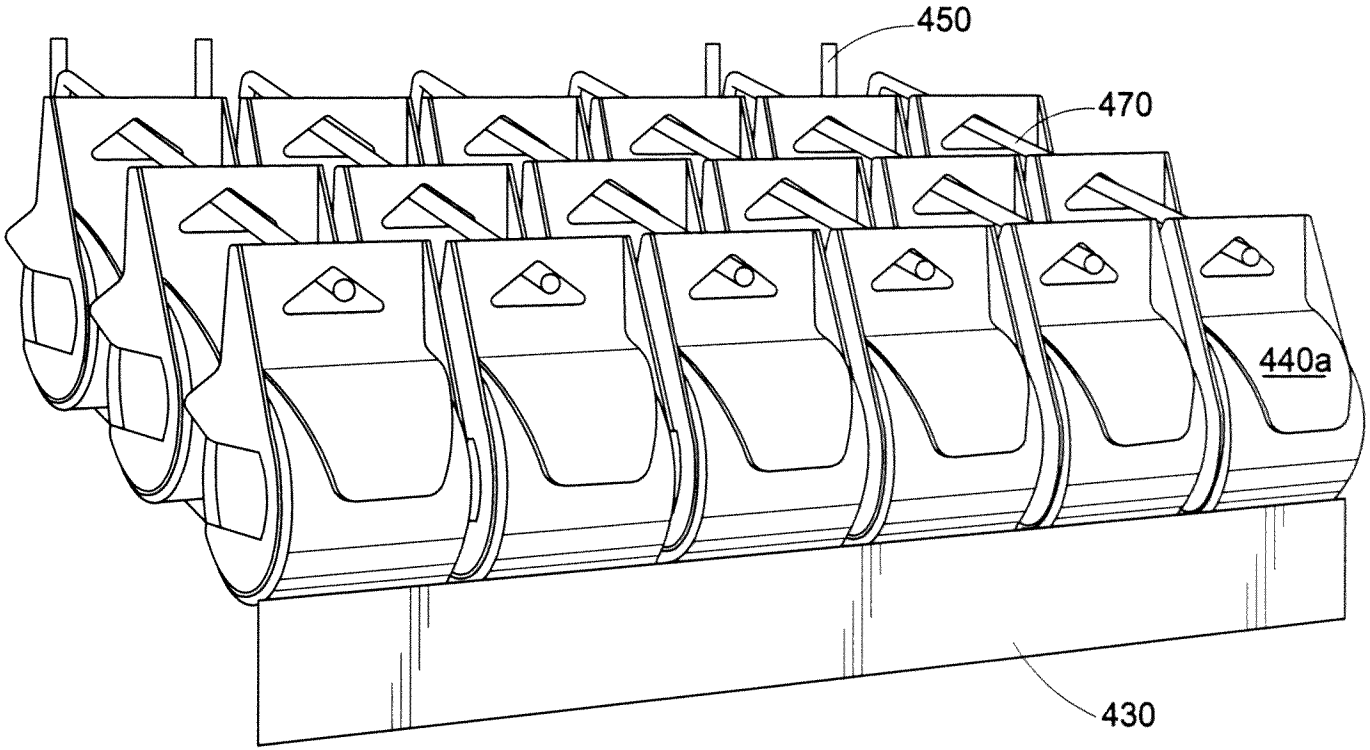
FIG. 8 is a perspective view of an embodiment of the disclosure similar to that seen in the right hand portion of FIG. 1 with tape on dispensers loaded on the merchandising system.
Figure 9:
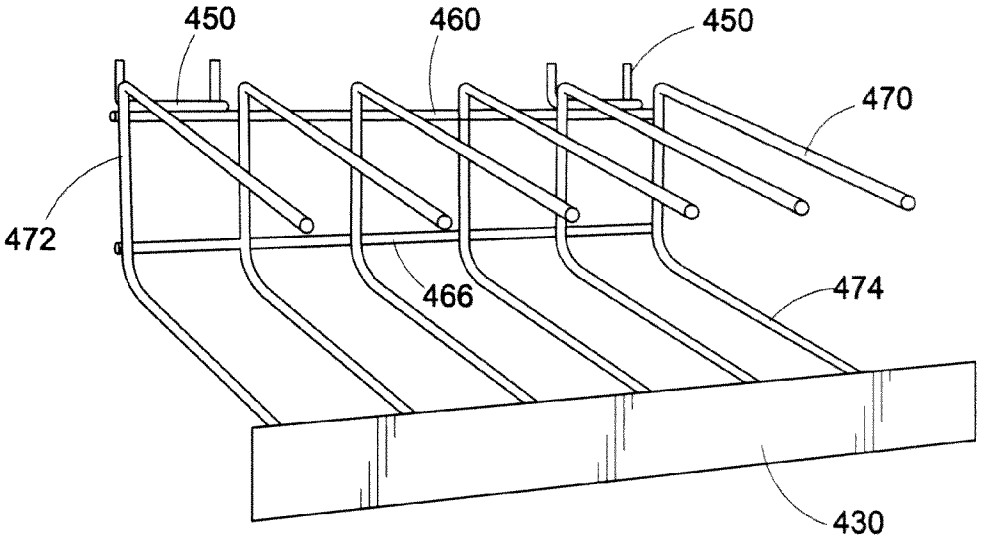
FIG. 9 is the embodiment of FIG. 8 shown without products loaded on the display.
Figure 10:
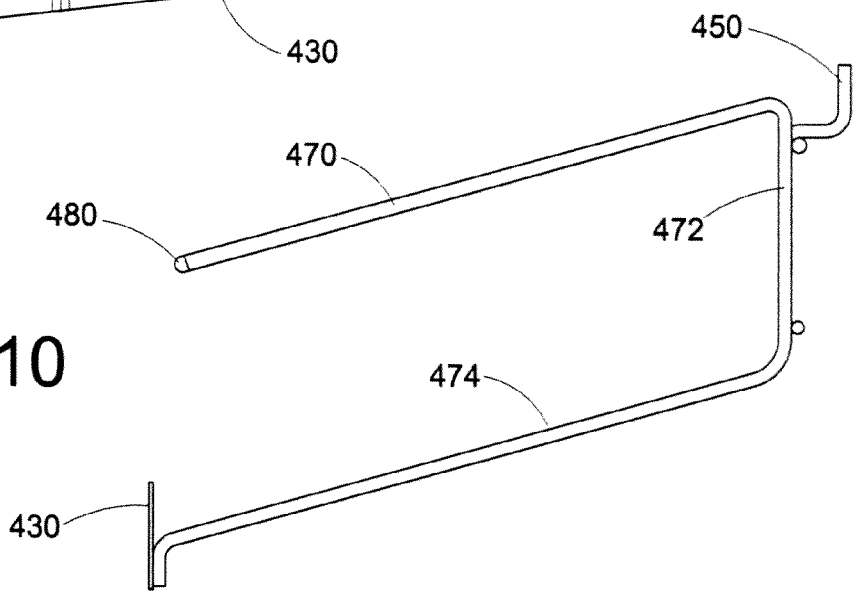
FIG. 10 is a side view of the embodiment of FIG. 9.

FIGS. 8, 9 and 10 show a variation of the embodiment of FIGS. 5, 6 and 7. The product illustrated 440*a* is a different tape product having a different width, height and depth when compared to the product 440 of FIGS. 5, 6 and 7. Therefore, the spacing between the upper rod segment 470 and the lower rod segment 474 is altered to accommodate different product height. Moreover, six rod or wire structures 466 are used rather than three. Because the product 440*a* has less width than the product 440, more products can be presented in a given area.

Figure 11:
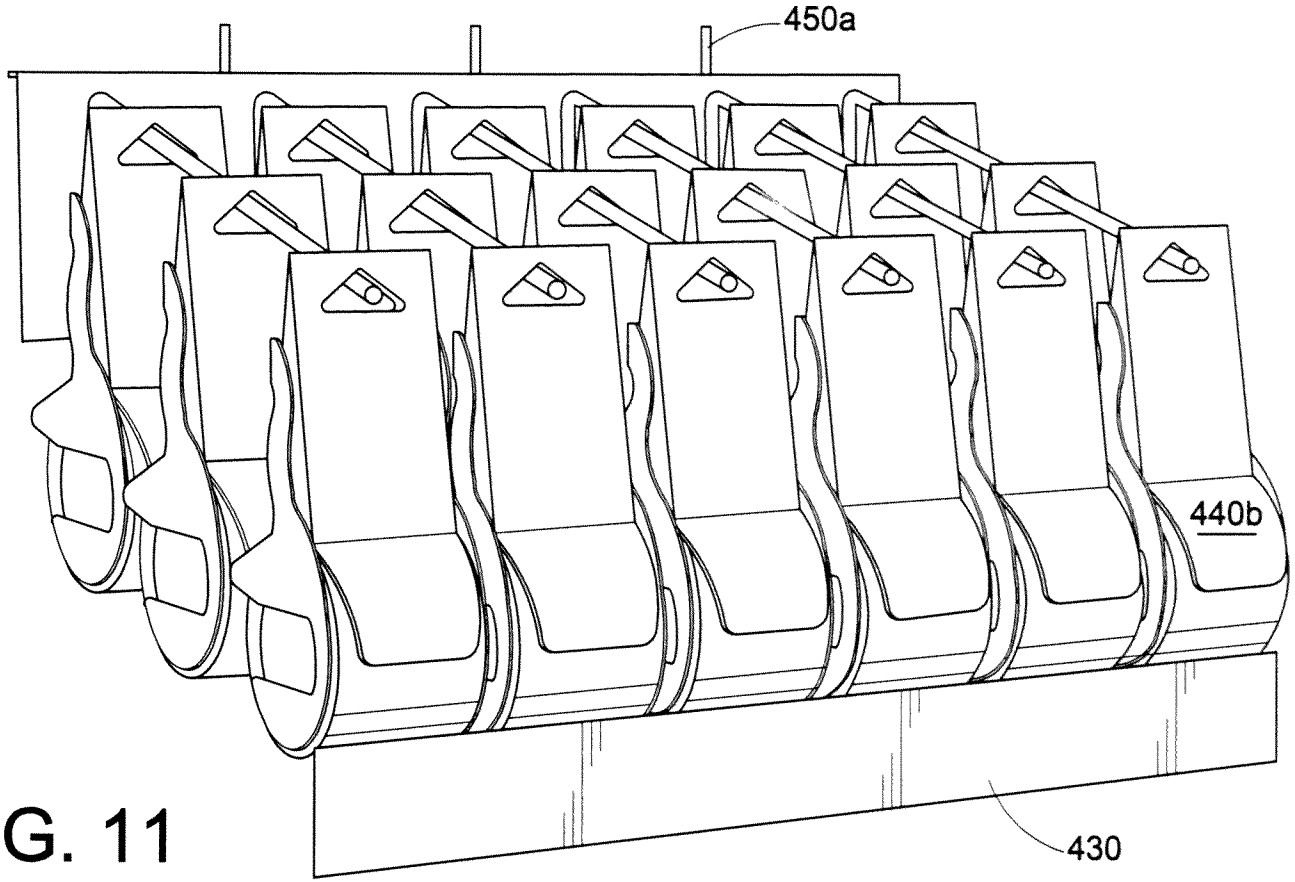
FIG. 11 is a perspective view of an embodiment similar to that seen in FIGS. 8-10 modified for tape dispensers having a larger height dimension than that seen in FIG. 8.
Figure 12:
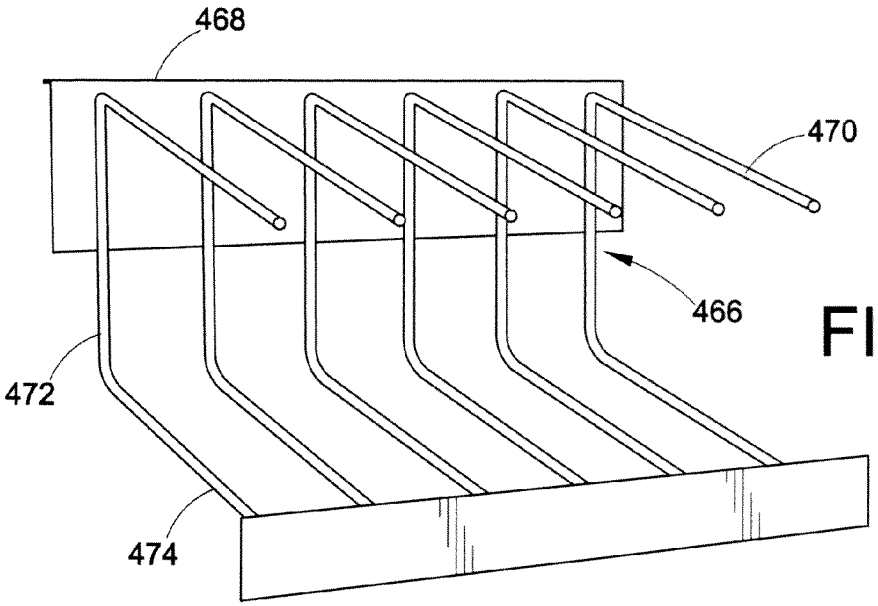
FIG. 12 is an illustration of the embodiment of FIG. 11 without tape dispensers.
Figure 13:
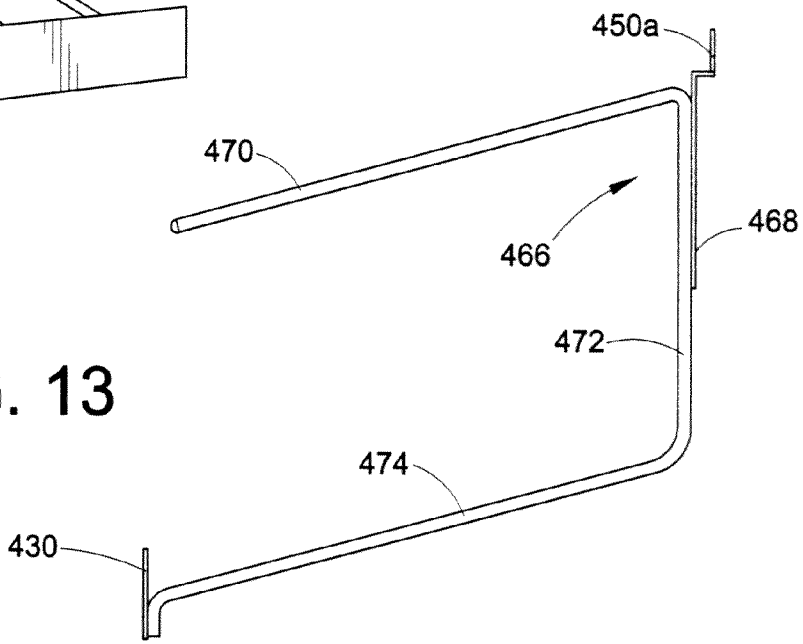
FIG. 13 is a side view of the embodiment of FIG. 12.

Another embodiment is shown in FIGS. 11, 12 and 13. This embodiment differs from the embodiment seen in FIGS. 8, 9 and 10 because of a different size product 440*b* and in the area of the back support. As can be seen in FIG. 11, the product 440*b* is taller than the product 440*a*. Because of this, the upper rod segment 470 and the lower rod segments 474 are spaced a greater distance apart to accommodate the larger product. Additionally, rather than an upper back support rod 460 and a lower back support rod 462, a single sheet metal back plane 468 is provided. The rod or wire structures 466 forming the rod segments 470, 472 and 474 are fixed to the back plane 468 by welding or the like at the back rod segments 472. Mounting brackets 450*a* can be punched from the sheet metal integral with the back plane 468 or formed identically to the mounting structures 450 and welded to the sheet metal back plane 468.

Figure 14:
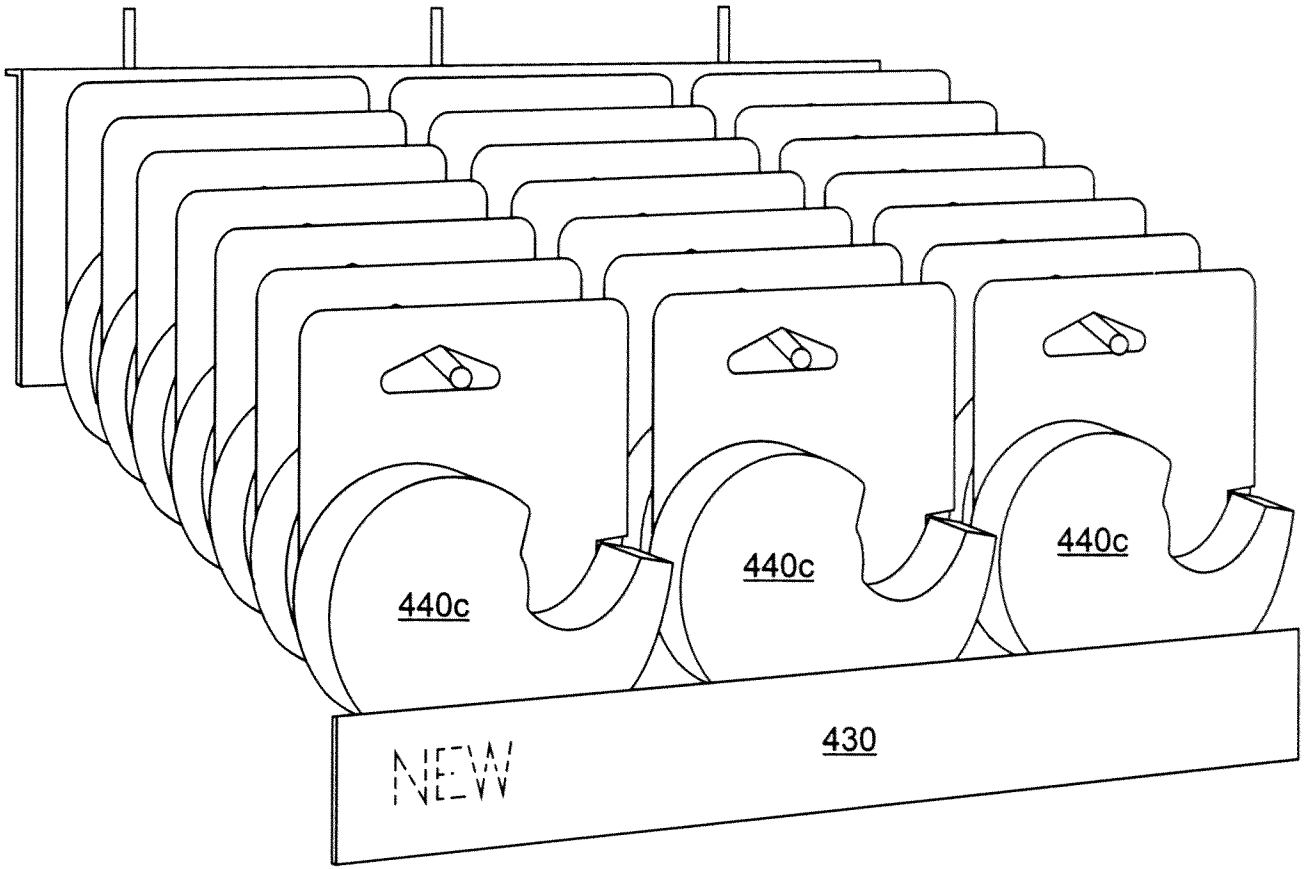
FIG. 14 is a perspective view of another embodiment of the disclosure showing packaged tape products similar to household invisible tape on a display system according to the disclosure.
Figure 16:
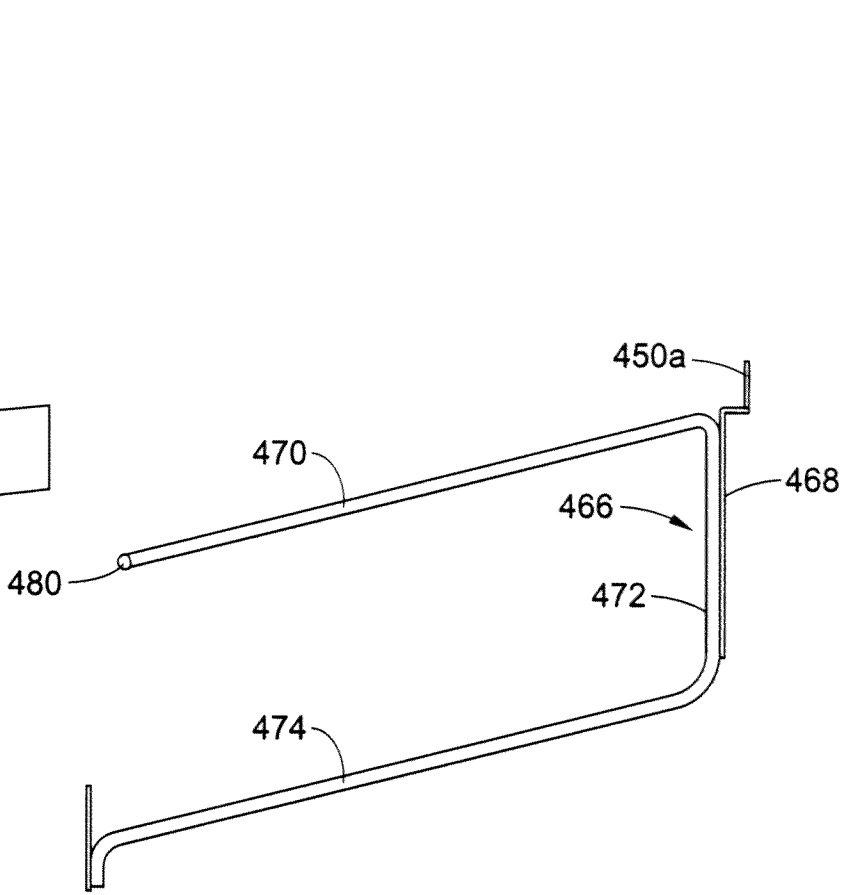
FIG. 16 is a side view of the embodiment of FIG. 15.
Figure 15:
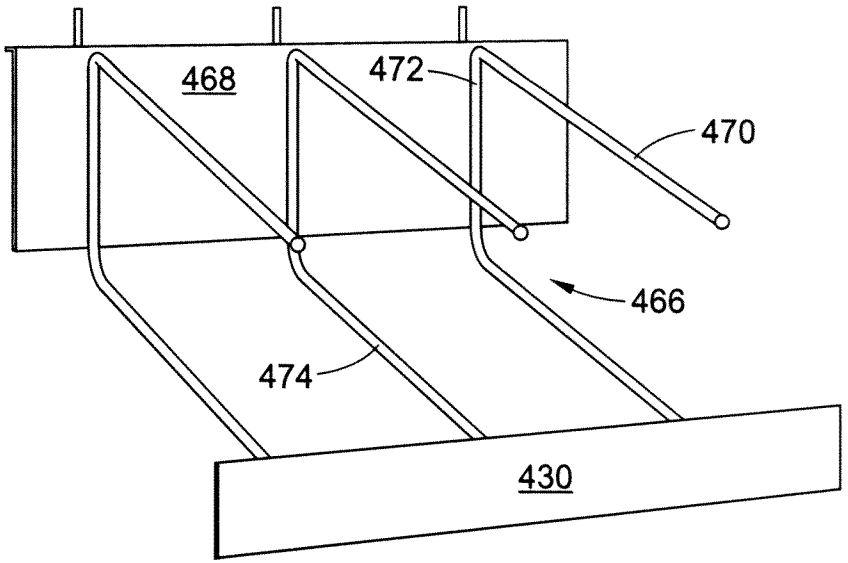
FIG. 15 is a perspective view of the embodiment of FIG. 14 shown without tape dispensers.

Another embodiment is shown in FIGS. 14, 15 and 16. This embodiment differs from the embodiment of FIGS. 11-13 in that the product 440*c* is different in height, depth and width when compared to the product 440*b*. This product is configured as one would expect transparent household tape to be configured. The rod or wire structures 466 are therefore spaced further apart both laterally and vertically to accommodate this product. In all other respects, the structures operate in a similar manner.

Figure 17:
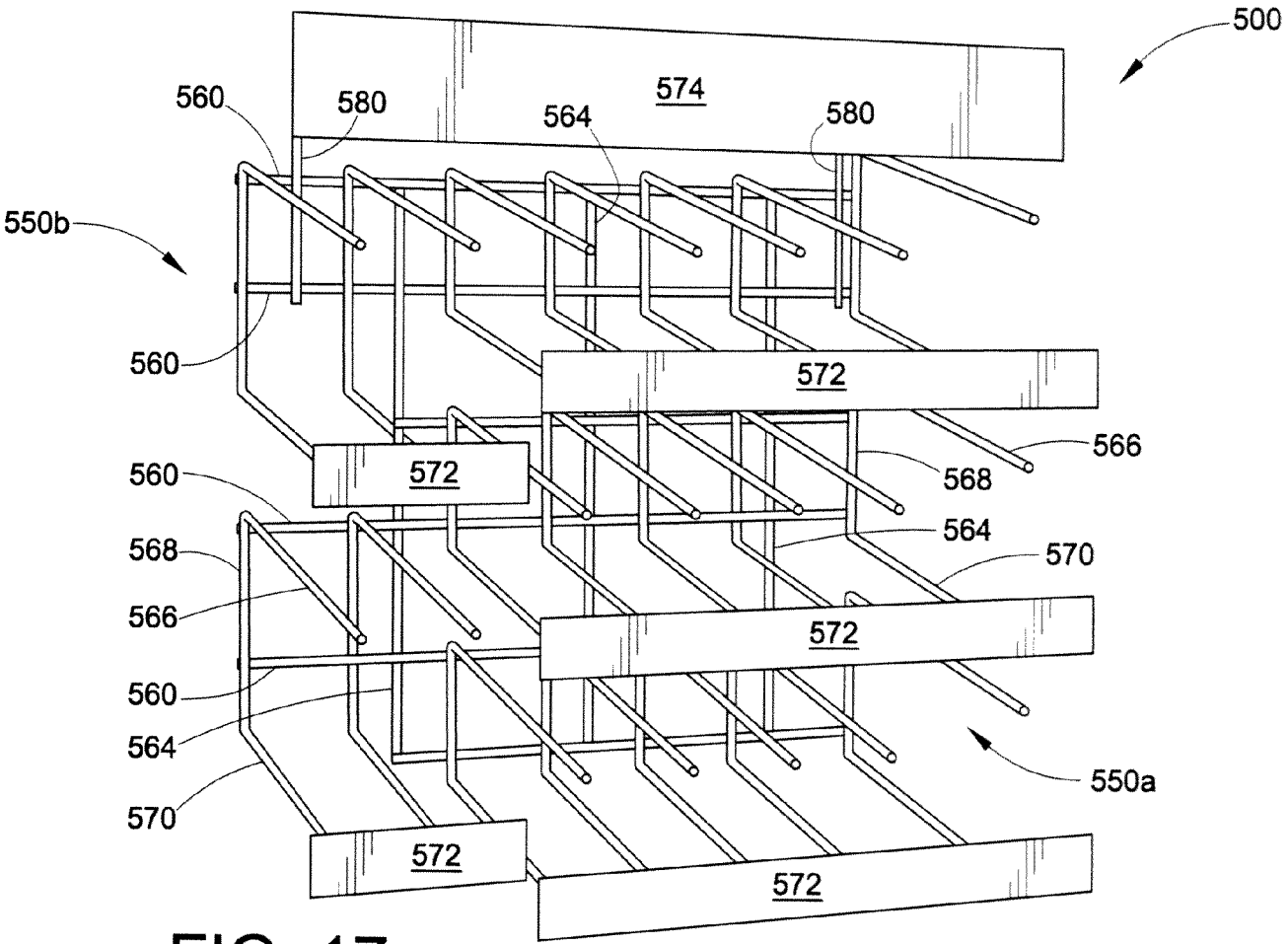
FIG. 17 is perspective view of another embodiment of the disclosure showing a display system having a header board.

As described above, the mounting structures and associated wire structures for supporting products can be ganged together in horizontal arrangements such as shown in FIGS. 6, 9, 12, etc. With reference to FIG. 17, it will further be appreciated that such structures can also be ganged together in vertical arrangements, and that the horizontal and vertical spacing of the rod segments within a given gang of structures can be varied as desired to provide a single merchandising display system for accommodating products of various sizes.

Figure 18:
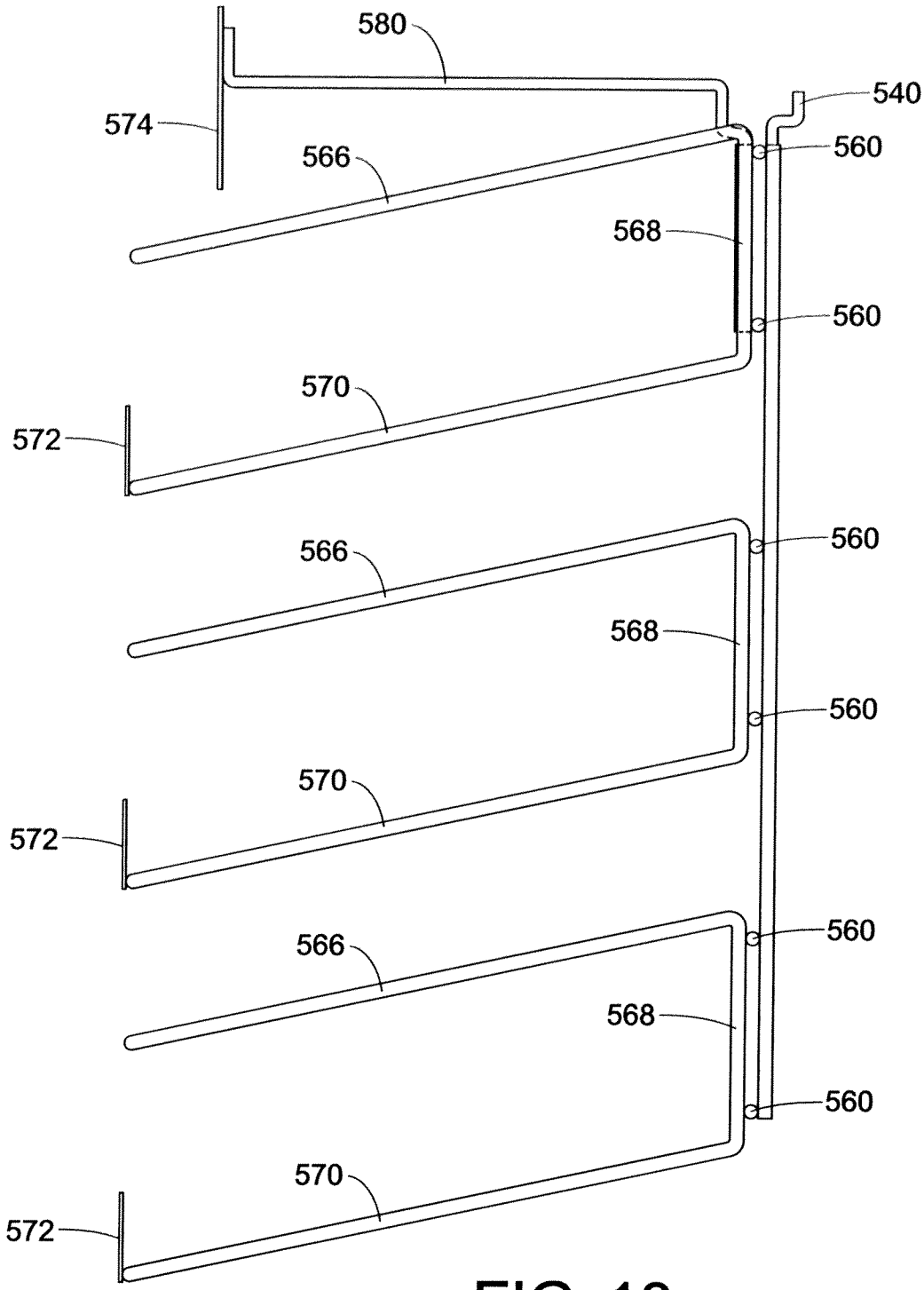
FIG. 18 is a side view of the display system of FIG. 17.

In FIGS. 17 and 18, an exemplary merchandising display system 500 is illustrated including a plurality of product support structures 550*a* and 550*b* arranged in a vertical and horizontal array for mounting to a peg board or other suitable support, such as in the manner previously described via mounting members 540 or the like. The support structures 550*a* and 550*b* are similar to the support structures shown and described above and are mounted to respective upper and lower horizontal support rods 560, which are in turn connected to vertical support rods 564. Each product support structure generally includes a wire or rod structure having an upper rod segment 566 (adapted to support a product), a back rod segment 568 (fixed to the support rods 560), and a lower rod segment 570 (adapted for supporting a product retaining bar 572), all as described previously. In this embodiment, the support structure 550*a* has a smaller vertical dimension than the product support structure 550*b*. As will be appreciated, the product support structures can have any desired dimensions for accommodating products of various shapes and sizes. Moreover, the product support structures can be arranged in any desired configuration in addition to the configuration shown in FIGS. 17 and 18.

In this embodiment, a header 574 is mounted above the product support structures 550*a* and 550*b*. The header 574 is supported by a pair of header support rods 580 that are secured to the horizontal support rods 560. The header 574 provides additional space for marketing materials, such as product information, uses, pricing, etc.

Figure 19:
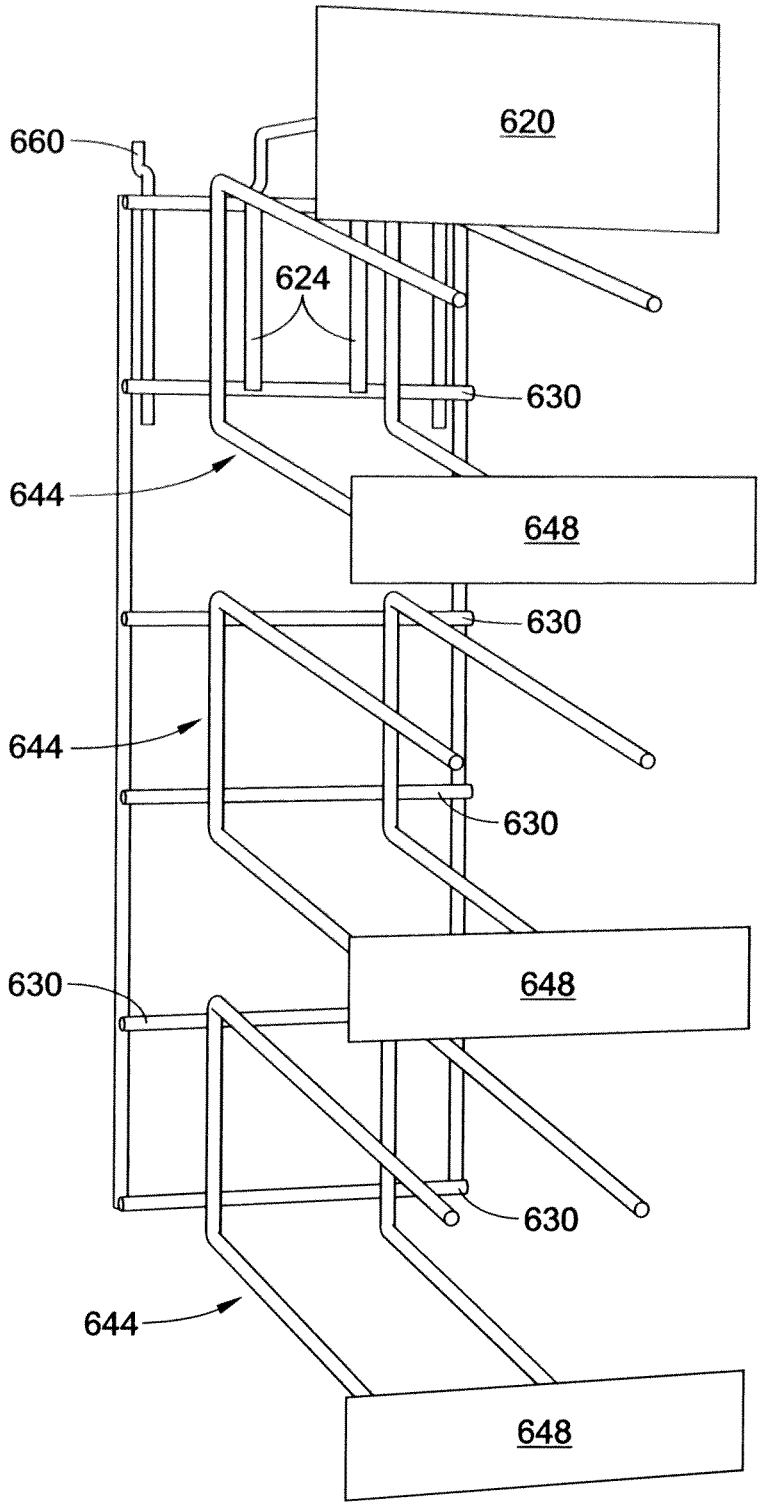
FIG. 19 is a perspective view of still another exemplary embodiment of the disclosure showing a display system having a releasably attachable header board.
Figure 20:
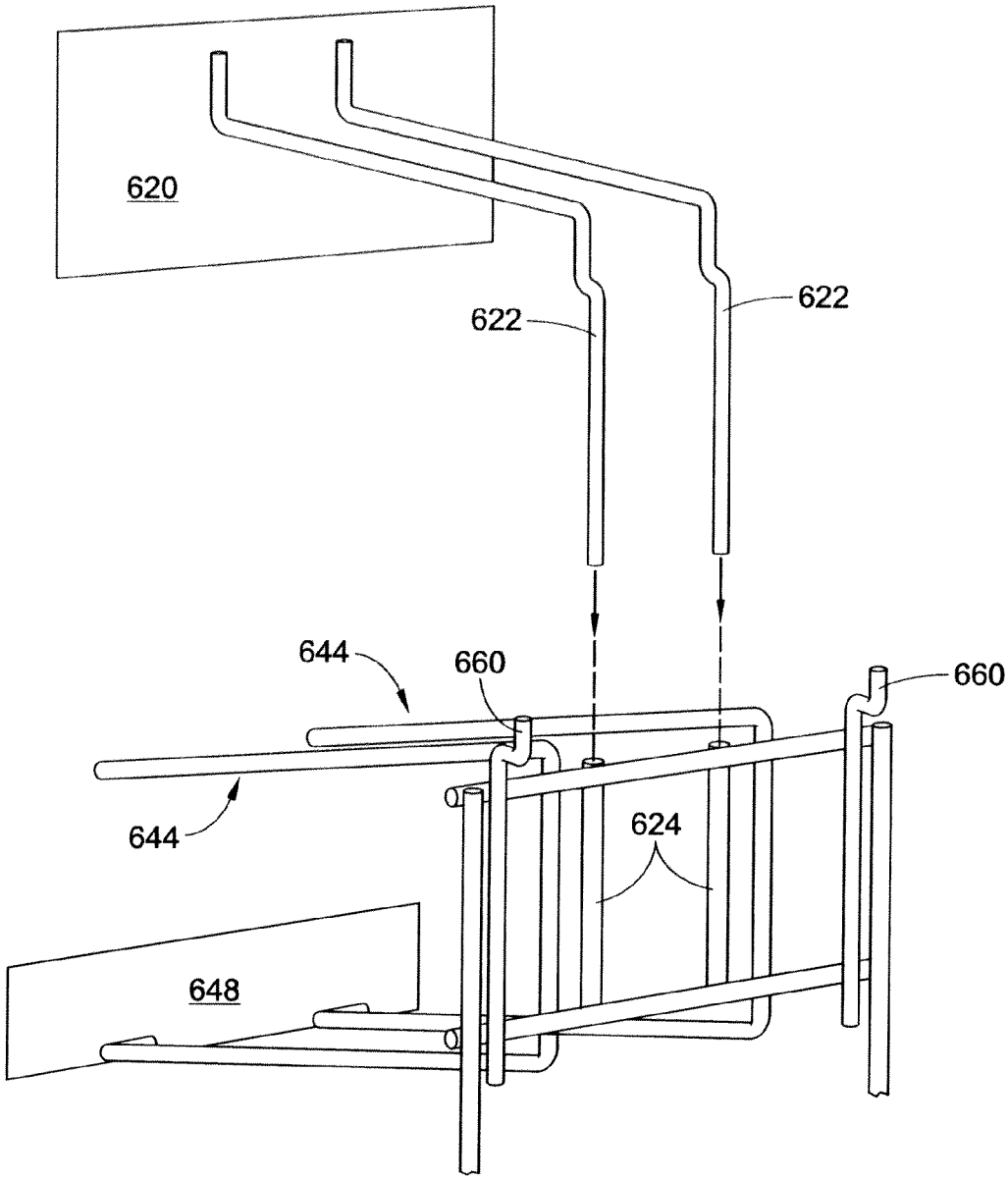
FIG. 20 is a rear perspective view of a portion of the display system of FIG. 19 illustrating the header board detached therefrom.

Turning to FIGS. 19 and 20, another exemplary merchandising display 600 is illustrated including a removably attachable header 620. The header 620 is supported by a pair of header support bars 222 that are receivable in respective mounting tubes 624 secured to horizontal support rods 630 or the display 600. In this manner, the header 620 can be easily removed or installed as desired. Like the other exemplary embodiments, the merchandising display 600 includes a number of product supports 644 adapted for supported products and/or product retaining bars 648. The display 600 is mountable to pegboard or the like via mounting members 660 in the manner previously described.

The present disclosure illustrates a merchandising display system which is flexible in application, inexpensive to manufacture and makes efficient use of retail product containing volume. Moreover, the present embodiments present products at the front of the product containing volume where they are most easily seen by the consumer and presents these products in an orderly way with the principle display panels most easily read. The present embodiments automatically bring products at the back of the product containing volume to the front of the product containing volume as products are purchased by consumers. The present embodiments are easily filled by store personnel and easily maintained by a retailer.

The disclosure has been described with reference to selected embodiments. Obviously, modifications and alterations will occur to others upon the reading and understanding of this specification. It is intended to include all such modifications and alterations insofar as they come within the scope of the appended claims or the equivalents thereof.

Having thus described the invention, it is claimed:

1. A merchandising display for displaying associated products having a height and a depth adapted to be displayed hanging from pegs comprising:

a product containing volume having a back and a front, said front being accessible to consumers;

a product support structure having an upper rod segment, a back rod segment, and a lower rod segment, the product support structure being a unitary piece;

the upper rod segment having a back end and a front end, said back end supported near said product containing volume back, said front end being disposed near said product containing volume front, said rod slanting downwardly from said back end to said front end at a slant angle; and a product retaining bar extending across the product containing volume parallel to and adjacent the front of the product containing volume, the bar being spaced below the front end of the upper rod segment and being positioned along said rod front end such that the associated product can engage the bar while being supported by the upper rod segment, wherein the upper rod segment and the lower rod segment extend from the back rod segment, and the product retaining bar extending upwards from the lower rod segment towards the upper rod segment;

whereby the associated product can be retained on the product support structure and presented in a generally vertical orientation adjacent the front of the product containing volume regardless of the number of products on the product support structure.

2. The merchandising display of claim 1, wherein said slant angle is at least ten degrees.

3. The merchandising display of claim 1, wherein said slant angle is at least fifteen degrees.

4. The merchandising display of claim 1, wherein said slant angle is selected from angles in the range from ten degrees to thirty degrees depending on the weight of the products to be displayed.

5. The merchandising display of claim 1, further comprising a vertically extending support member at the back of said product volume, wherein the back rod segment is connected to said support member and said upper and lower rod segments extend from the back rod segment in a cantilevered manner.

6. The merchandising display of claim 5, wherein the vertically extending support member includes a peg board.

7. The merchandising display of claim 5, wherein the back rod segment is secured to the vertically extending support member.

8. The merchandising display of claim 1, wherein the upper rod segment and lower rod segment extend in spaced apart relation from the back rod segment, and are parallel along a major portion of their respective lengths.

9. The merchandising display of claim 1, wherein the upper rod segment and lower rod segment extend in spaced apart relation from the back rod segment, and wherein distal ends of the upper and lower rod segments are spaced farther apart than proximal ends of the upper and lower rod segments.

10. The merchandising display of claim 1, further comprising a plurality of product support structures each having an upper rod segment, a back rod segment, and a lower rod segment, wherein the product retaining bar extends across the front of the product containing volume and is spaced below the front ends of the upper rod seqments of the plurality of product support structures.

11. The merchandising display of claim 10, wherein at least two of the plurality of product support structures have different shapes.

12. The merchandising display of claim 1, further comprising a header board extending across the product containing volume parallel to and adjacent the front of the product containing volume.

13. The merchandising display of claim 12, wherein the header board is releasably attachable to the product support structure.

14. The merchandising display of claim 1, wherein the product retaining bar comprises a planar surface extending towards the upper rod segment.

15. The merchandising system of claim 1, wherein the upper rod segment, back rod segment, and lower rod segment are comprised of a single rod having at least three straight portions and at least two bent portions between the at least three bent portions.

16. The merchandising system of claim 1, wherein the upper rod segment includes a horizontal portion for supporting an associated product near the first end, the horizontal portion being spaced a larger distance from the front of the product containing volume than the product retaining bar, whereby an associated product having a top with a shallow depth and a bottom with a larger depth can be maintained in a vertical orientation when supported on the horizontal portion of the upper rod segment and engaged with the product retaining bar.

17. The merchandising display of claim 16, wherein the at least one product includes a tape roll having a top portion for hanging having a relatively shallow depth and a lower portion including a roll having a relatively greater depth, wherein the upper rod segment has a horizontal portion for retaining the top portion in a position near the front end of the upper rod segment, and wherein the product retaining bar is spaced farther from the product volume back than the horizontal portion of the upper rod segment such that the top portion of the tape roll is maintained in a substantially vertical orientation with the roll engaged with the product retaining bar.

* * * * *